United States Patent [19]

Kajiyama

[11] 4,456,096

[45] Jun. 26, 1984

[54] TERMINAL SLOWDOWN APPARATUS FOR ELEVATOR

[75] Inventor: Ryuichi Kajiyama, Inazawa, Japan

[73] Assignee: Mitsubishi Denki Kabushiki Kaisha, Tokyo, Japan

[21] Appl. No.: 343,773

[22] Filed: Jan. 28, 1982

[30] Foreign Application Priority Data

Jul. 6, 1981 [JP] Japan ..... 56-105284

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 4,067,416 | 1/1978 | Lowry | 187/29 |
| 4,128,141 | 12/1978 | Caputo et al. | 187/29 |
| 4,225,015 | 9/1980 | Yamada | 187/29 |
| 4,318,456 | 3/1982 | Lowry | 187/29 |
| 4,356,896 | 11/1982 | Tamura et al. | 187/29 |

FOREIGN PATENT DOCUMENTS 55-98069 7/1980 Japan .

*Primary Examiner*—B. Dobeck
*Assistant Examiner*—W. E. Duncanson, Jr.
*Attorney, Agent, or Firm*—Oblon, Fisher, Spivak, McClelland & Maier

[57] ABSTRACT

A terminal slowdown apparatus for an elevator which reads in outputs given by contacting a car with terminal detectors placed depending upon a terminal floor to operate a terminal slowdown signal which is reduced depending upon the distance to the terminal floor and to output the lower signal between the normal speed command signal and the terminal slowdown signal, including a first processor which outputs an acceleration command signal increasing from the start of the car at an acceleration lower than an acceleration of the car given in the start of the car during the saturation fault of the normal speed command signal; a terminal detector which is placed at the point wherein the acceleration command signal is equal to the terminal slowdown command signal generated at the position reaching to the normal slowdown starting position in the rated speed running of the car; a second processor which operates the slowdown command reducing depending upon the distance from the terminal floor to the position for operating the terminal detector; and a third processor which compares the output of the first processor with the output of the second processor to output the lower output as the terminal slowdown command signal.

3 Claims, 15 Drawing Figures

| Address | Data |
|---|---|
| VDI | Dco |
| VDI+1 | Dc1 |
| VDI+2 | Dc2 |
| VDI+P2 | Dcb |
| VDI+n | Dcn |
| VDI+i-1 | Dci-1 |
| VDI+i | Dci |
| VDI+i+1 | Dci+1 |
| VDI+P1 | Dca |

16C

TERMINAL SLOWDOWN APPARATUS FOR ELEVATOR

BACKGROUND OF THE INVENTION

1. Field of the Invention

The present invention relates to a terminal slowdown apparatus for slowing and stopping an elevator car to land the car at a terminal floor.

2. Description of the Prior Art

A speed feedback control system for controlling the speed of an elevator car depending upon a speed command signal has been employed to slowdown the car with a secure feeling to passengers and to land the car precisely at the predetermined floor. It has been considered to use a computer for this purpose.

Referring to FIGS. 1 to 3, the system is briefly illustrated, through the system is further described in detail.

In FIGS. 1 to 3, the reference (1) designates a top floor; (2) designates a cam placed in a hoist way at each point departed for a predetermined distance $L_0$ from each floor; (3A)–(3D) respectively designate the first–fourth terminal floor detectors which are switches vertically placed at points departed for each distance $L_1$–$L_4$ ($L_0>L_1>L_2>L_3>L_4$) from the top floor (1); (4) designates the car of the elevator; (5) designates a slowdown starting point detector which is a switch which contacts with the cam (2) placed on the car (4); (6) designates a cam placed on the car (4) to contact with the terminal floor detectors (3A)–(3D); (7) designates a counterweight; (8) designates a main rope which connects the car (4) to the counterweight (7); (9) designates a traction sheave of a traction machine for winding the main rope (8); (10) designates a traction motor for driving the sheave (9); (11) designates a pulse generator which is connected to the motor to generate pulses in proportion to the revolution speed of the motor (10); (12) designates a pulse counter which counts pulses corresponding to the travel distance of the car (4) from the output of the pulse generator (11) to generate car position signals **(12*a*); (13) designates a call detection signal for detecting calls at the floors; (14) designates a digital processor; (15) designates a D/A converter which converts the digital signal from the processor (14) into an analog signal to generate a normal slowdown command signal Vn; (16) designates a digital processor which is separated from the digital processor (14); (17) designates a D/A converter which converts the digital output signal from the processor (16) into an analog signal to generate a terminal slowdown command signal Vs and which comprises D flip-flops (17*a*), (17*b*), (17*c*) and a D/A converter (17*d*) as shown in FIG. 14, the D/A converter (17) acting to write digitized pattern data from the CPU (16B) of the digital processor (14) in the D flip-flops so as to perform a D/A conversion into analog data. The polarity of the pattern is controlled by the SIGN of the D/A converter (17*d*); (18) designates a comparator circuit which selects the normal slowdown command signal Vn when $Vn<Vs$ and the terminal slowdown command signal Vs when $Vn\geqq Vs$; (19) designates a speed control device for controlling the motor (10); and (20) designates a down counter for subtracting pulses of the pulse generator (11), the down counter including converters (20*a*) (20*b*) and a tri-state gate (20*c*) as shown in FIG. 15**.

A predetermined output is given when the car (4) reaches a point departed by the predetermined distance $L_0$ from the calling floor (hereinafter referred to as a stop floor) upon contact of the cam (2) with the slowdown starting point detector (5). The digital processor (14) calculates a distance from the present position of the car (4) to the stop floor (1) (hereinafter referred to as a residual distance) based on the output of detector (5), the car position signal **(12*a*) and the calling detection signal (13). The data corresponding to the residual distance is read out from the slowdown command data memorized in a memory device within processor (16). The data is converted into analog data by the D/A converter (15) to output it as the normal slowdown command signal Vn and to input it into the speed control device (19) whereby the speed of the motor (10) is controlled and the car (4) is slowed down to land at the stop floor (1)**. This operation is performed for the terminal floors and other floors in the same manner.

On the other hand, when the car (4) approaches the terminal floor such as the top floor (1) and contacts the cam (6) with the terminal detector (3A), the detector (3A) is actuated and the digital processor (16) processes the residual distance $L_1$ from the present position of the car (4) to the top floor (1). In the same manner for the normal slowdown command, the data corresponding to the residual distance is read out from the slowdown command data memorized in a memory device within processor (14) to output the terminal slowdown command signal Vs from the D/A converter (17).

FIG. 2 shows the relation of the normal slowdown command signal Vn and the terminal slowdown signal Vs. In the normal state, $Vn<Vs$ is given. The traction motor (10) is controlled during slowdown by the normal slowdown command signal Vn. If $Vn\geqq Vs$ is given due to a certain fault in the pulse counter (12) or the slowdown starting point detector (5), the terminal slowdown command Vs is generated from the compartor circuit (18) to land the car (4) safely at the top floor (1) in a slowdown mode.

FIG. 3 shows the relation of the terminal slowdown command signal Vs and the terminal detectors (3A)–(3C). The positions of the terminal detectors (3A)–(3C) are decided as follows (the terminal detector (3D) not being shown):

(1) the first terminal detector (3A) is placed at the point $P_1$ slightly higher than the normal slowdown position $P_0$ in the rated speed running (the position departed for the residual distance $L_0$);

(2) the second terminal detector (3B) is placed at the point $P_2$ wherein the true speed $Va_1$ of the car (4) in the start from the position $P_1$ at an acceleration a is equal to the terminal slowdown command signal Vs;

(3) the third terminal detector (3C) is placed at the position $P_3$ wherein the true speed $Va_2$ of the car (4) in the start from the position $P_2$ at an acceleration a is equal to the terminal slowdown command signal Vs; and (4) the i th terminal detector is placed at the position $P_i$ wherein the true speed of the car in the start from the position $P_{i-1}$ at an acceleration is equal to the terminal slowdown command signal Vs.

The terminal detectors (3A)–(3D) are placed in the same manner to the positions before the place wherein the distance from the position Pi to the top floor (1) is less than ½ of the minimum floor distance allowed at the rated speed. In this designation, the cam (6) contacts with the terminal detectors (3B)–(3D) without increasing the true speed of the car (4) over the terminal slowdown command signal Vs even though the car (4) starts from the position $P_1$ or higher. Thus, the terminal slowdown command signal Vs is operated whereby the car (4) safely land at the top floor (1).

The acceleration a is determined to be the maximum acceleration of the car (4) in the case of the start of the car at the saturation fault for generating the largest, normal speed command signal Vn. The maximum acceleration is determined by the limit of the traction of the traction machine and is usually 2.0 m/S$^2$. In the case of deceleration of the terminal slowdown command signal Vs of 0.9 m/S$^2$ and the rated speed of 240 m/min, 8 of the terminal detectors (3A)-(3*i*) are needed. That is, many terminal detectors are needed whereby the arrangements and control are not easy and the devices are expensive.

SUMMARY OF THE INVENTION

It is an object of the present invention to improve the conventional system having the above-noted disadvantages and to provide an elevator terminal slowdown apparatus having a smaller number of terminal detetors and which safely lands a car at a terminal floor.

The foregoing and other objects of the present invention have been attained by providing an elevator terminal slowdown apparatus which reads in outputs given by contacting a car with terminal detectors placed depending upon a terminal floor to operate a terminal slowdown signal which is reduced depending upon the distance to the terminal floor and to output the lower signal among the normal speed command signal and the terminal slowdown signal, which includes a first processor which outputs an acceleration command signal increasing from the start of the car at an acceleration lower than an acceleration of the car given in the start of the car during the saturation fault of the normal speed command signal; a terminal detector which is placed at the point wherein the acceleration command signal is equal to the terminal slowdown command signal generated at the position reaching to the normal slowdown starting position in the rated speed running of the car; a second procesor which operates slowdown command reducing depending upon the distance from the terminal floor to the position for operating the terminal detector; and a third processor which compares the output of the first processor with the output of the second processor to output the lower output therebetween as the terminal slowdown command signal.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 4:
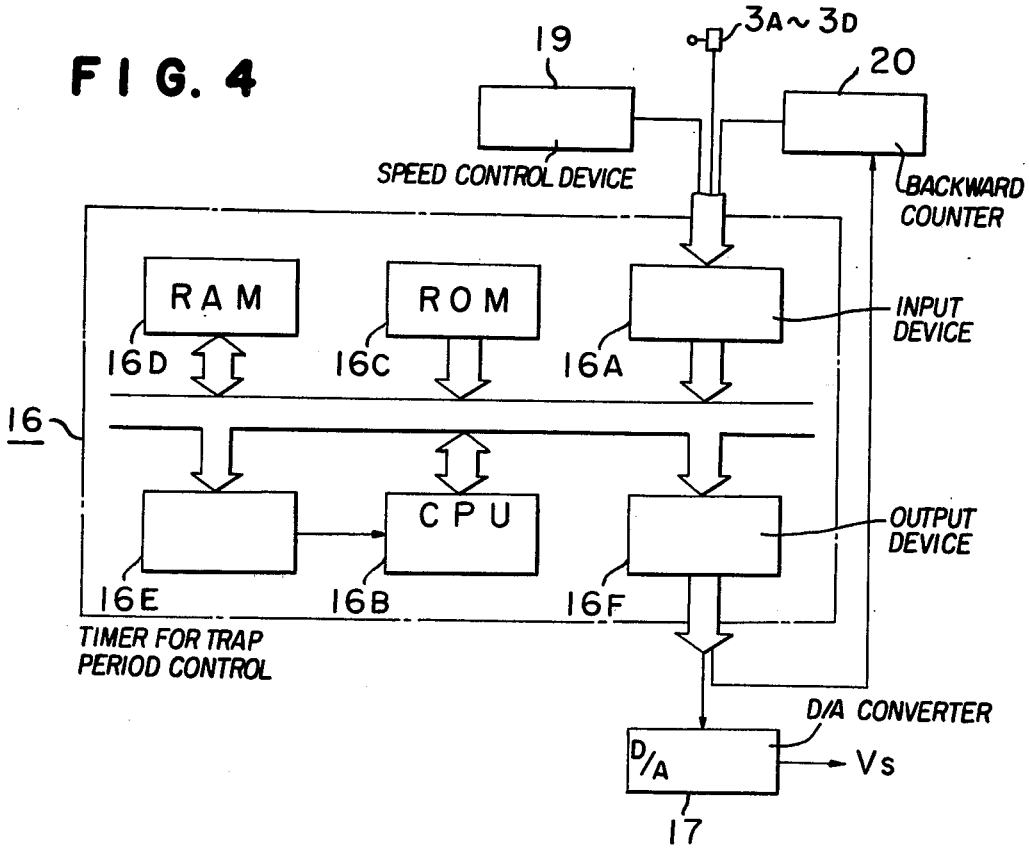
FIG. 4 is a block diagram of one embodiment of the elevator terminal slowdown apparatus of the present invention, especially a digital processor (16) corresponding to that also shown in FIG. 1.

Referring now to the drawings, wherein like reference numerals designate identical or corresponding parts throughout through the several views, and more particularly to FIG. 4 thereof, in FIG. 4, the reference (16A) designates an input device (INTEL 8212 by INTEL Corp.) which receives output signals of the terminal detectors (3A)-(3D), the down counter (20) and the speed control device (19); (16B) designates a central processing unit (CPU) (INTEL 8085A by INTEL Corp.) of a micro-computer; (16C) designates a read-only memory (ROM) (INTEL 2716 by INTEL Corp.) in which programs and fixed data are memorized; (16D) designates a random access memory (RAM) (INTEL 2114A by INTEL Corp.) which memorizes data such as the results of processing; (16E) designates a timer for trap period control (INTEL 8155 by INTEL Corp.); (16F) designates an output device (INTEL 8212 by INTEL Corp.) for outputting an output signal from the CPU (16B).

Figures 5, 6:
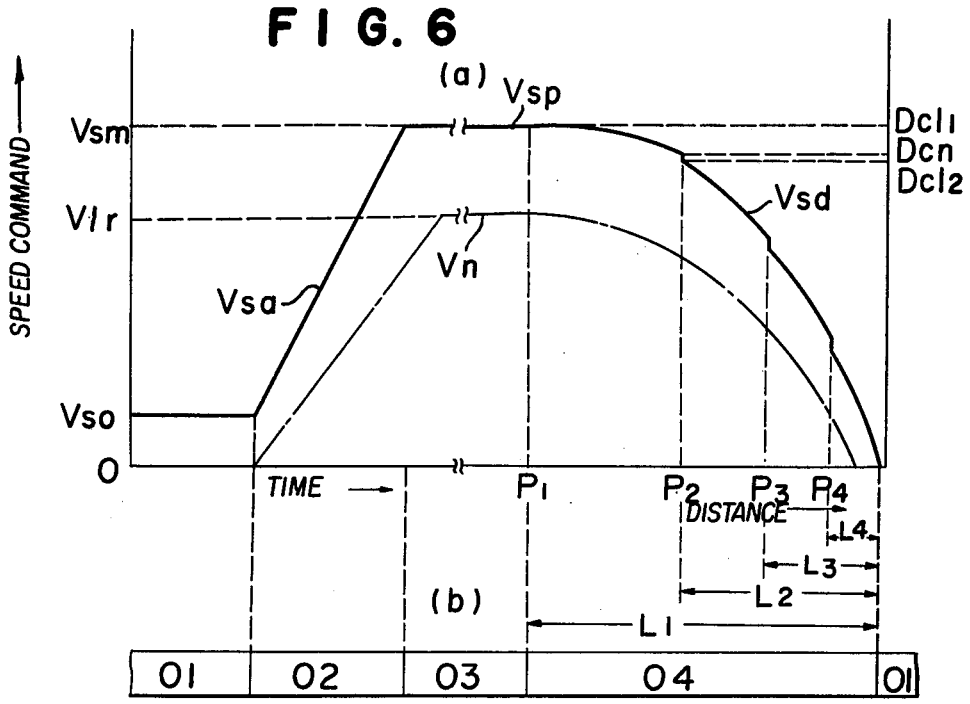
FIG. 5 is a diagram for illustrating the organization of the ROM of FIG. 4.
FIG. 6 is a graph showing speed command curves and operation modes.

In FIG. 5, VDI, $VDI_{+1}$, $VDI_{+2}$ . . . $VDI_{+P2}$ . . . $VDI_{+n}$ . . . $VDI_{+i-1}$, $VDI_{+i}$, $VDI_{+i+1}$ . . . $VDI_{+P1}$ . . . designate addresses corresponding to the residual distances; $D_{c0}$, $D_{c1}$, $D_{c2}$, $D_{cb}$ . . . $D_{cn}$ . . . $D_{ci-1}$, $D_{ci}$, $D_{ci+1}$ . . . $D_{ca}$ . . . designate slowdown command data corresponding to the addresses.

In FIG. 6, the reference Vsp designates a processed terminal speed command; Vsa designates an acceleration command thereof, Vsd designates a slowdown command thereof; (01)-(04) designate operation modes, (01); a wait mode; (02): an acceleration mode; (03): constant speed mode; and (04): a deceleration mode.

In FIGS. 7 to 13, the references (31), (32), (41)-(44), (51)-(54), (61)-(65), (71)-(86), (91)-(95) and (101)-(104) designate serial operations of the digital processor (16).

The operation of the embodiment is briefly illustrated.

When the start command is fed from the control device (19) through the input device (16A) into CPU (16B) of the processor (16), the terminal speed command Vsp shown in FIG. 6 is produced by operation of a terminal slowdown command operation program memorized in ROM (16C), to output the data from the output device (16F) to D/A converter (17). The terminal speed command signal Vsp produced is characterized by the initial signal Vso larger than the normal speed command signal Vn in the wait mode (01), so that the normal speed command signal Vn can be always selected from the comparator circuit (18) so as to prevent an erroneous operation of the comparator circuit (18). When the start command is input, the operation in the acceleration mode (02) is performed. That is, D/A converter (17) outputs the acceleration command Vsa which increases at an acceleration which is slightly larger than the gradient (acceleration) of the normal speed command signal Vn and smaller than the acceleration of the true speed $Va_1$, $Va_2$ of the car (4) in FIG. 3. When the acceleration command Vsa reaches to the predetermined speed Vsm larger than the rated speed $V_1$, the operation in the constant speed mode (03) is performed to maintain the terminal speed command Vsp to the predetermined speed Vsm.

When the first terminal detector (3A) is actuated by the cam (6), the pulses corresponding to the predetermined distance $L_1$ are preset in the down counter (20) which initiates subtraction upon receiving the output pulses of the pulse generator (11). The contents of the down counter (20) correspond to the residual distance from the present position of the car (4) to the top floor (1). When the first detector (3A) is actuated, operation in the slowdown mode (04) commences and the slowdown command Vsd is operated and output as follows. That is, the residual distance data corresponding to the contents of the down counter (20) is input through the input device (16A) and the slowdown command corresponding to this data is extracted from ROM (16C) and output via the output device (16F). When the second terminal detector (3B) is actuated by ascending of the car (4), the pulses corresponding to the predetermined distance $L_2$ are preset in the down counter (20) to calibrate the residual distance. Thus, the slowdown command Vsd is calibrated as shown in FIG. 6. In the same manner, the pulses corresponding to the predetermined distances $L_3$, $L_4$ are preset by the actuations of the third and fourth terminal detectors (3C), (3D). The slowdown command Vsd having high distance accuracy is operated and output.

Referring to the flow charts of FIGS. 7 to 13, the operations will be further illustrated.

Figure 7:
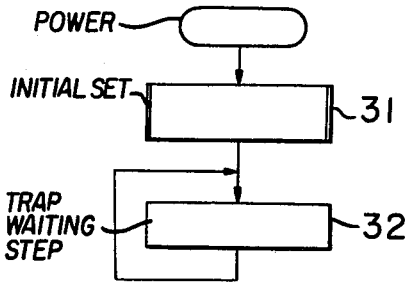
FIGS. 7 to 13 are flow charts showing serial operations of the digital processor (16) of the invention.

In the step (31) shown in FIG. 7, the initial set is automatically given by connection of the power source to the processor (16) to shift to the trap waiting step (32).

Figure 8:
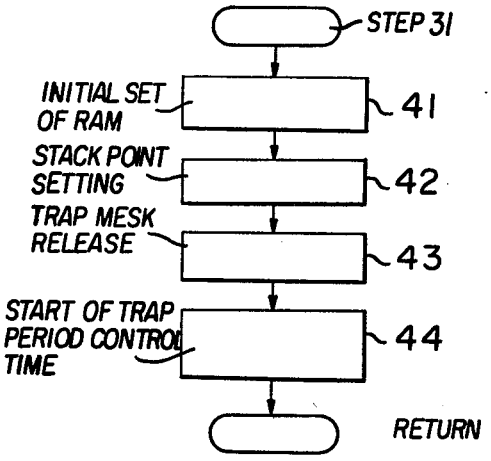

The initial set of the RAM (16D) is given in the step (41) shown in FIG. 8 and the stack pointer is set in the step (42) and the trap mask is released in the step (43) and the trap period control timer (16E) is started in the step (44).

Figure 9:
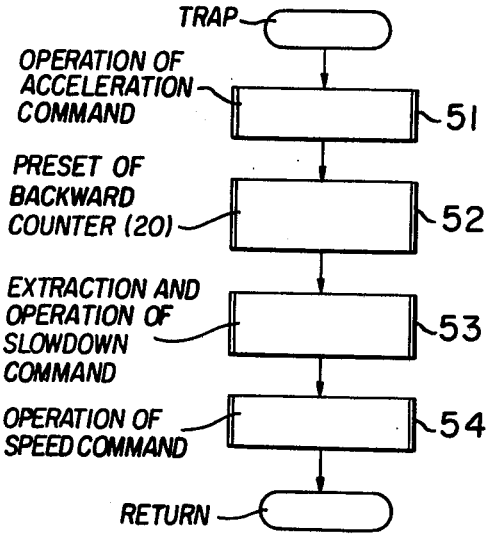

When the trap is input from the timer (16E) to CPU (16B) in the step (51) shown in FIG. 9, the acceleration command Vsa is operated. The down counter (20) is preset in the step (52) to extract and to operate the slowdown command Vsd, and the terminal speed command Vsp is operated in the step (54).

Figure 10:
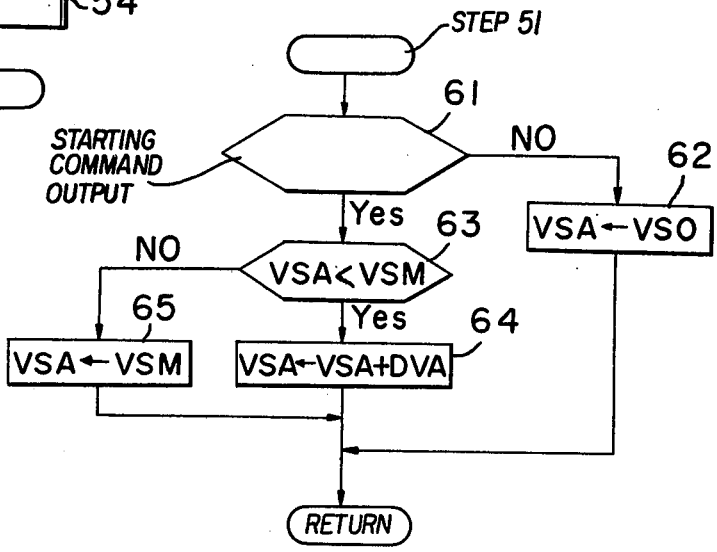

In the step (61) shown in FIG. 10, it is determined whether the starting command is output or not. When the starting command is not output, the acceleration command VSA is kept at VSO as the datum in the wait mode (01) in the step (62). When the starting command is output, it is shifted to the step (63) to compare the acceleration command VSA with the predetermined VSM. In the case of VSA<VSM, the sum of the predetermined increase component DVA and the acceleration command VSA is used as the new acceleration command VSA in the step (64). That is, the operation of the acceleration mode (02) is performed in the step (64). When the acceleration command VSA increases to be VSA≧VSM, the acceleration command VSA is kept in the predetermined value VSM in the step (65).

Figure 11:
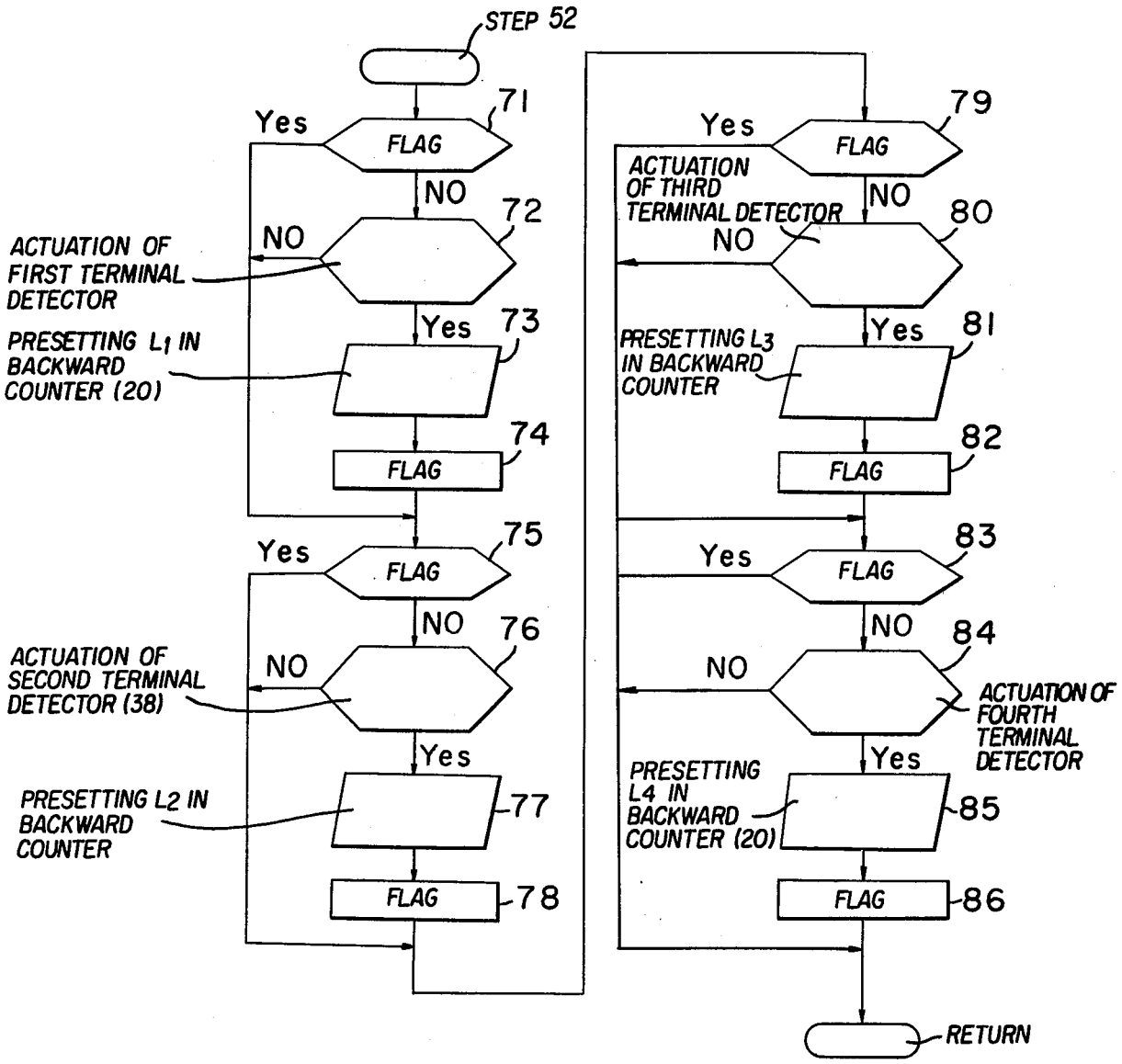

In the step (71) shown in FIG. 11, the condition of the flag $S_1$ is elected. When it is not set, as shown in Figure, the steps (72)-(74) are performed. When it is preset to "1" these steps are not performed and operation is shifted to the step (75). In the step (72), the operation of the first terminal detector (3A) is determined. When it is actuated, it is shifted to the step (73) whereas when it is not actuated, it is shifted to the step (75).

In the step (73), the predetermined distance datum $L_1$ obtained by actuating the first terminal detector (3A) is preset in the down counter (20). After actuating the first terminal detector (3A) the flag $S_1$ is set to "1" in the step (74) in order to perform the steps (72)-(74) only once. In the same manner, when the second terminal detector (3B) is performed at the first and second terminal acceleration in the steps (75)-(78), the predetermined distance datum $L_2$ is preset into the down counter (20). In the steps (79)-(82), the predetermined distance datum $L_3$ is preset into the down counter (20) by the actuation of the third terminal detector (3C). In the steps (83)-(86), the predetermined distance datum $L_4$ is preset into the down counter (20) by the actuation of the fourth terminal detector (3D).

Figure 12:
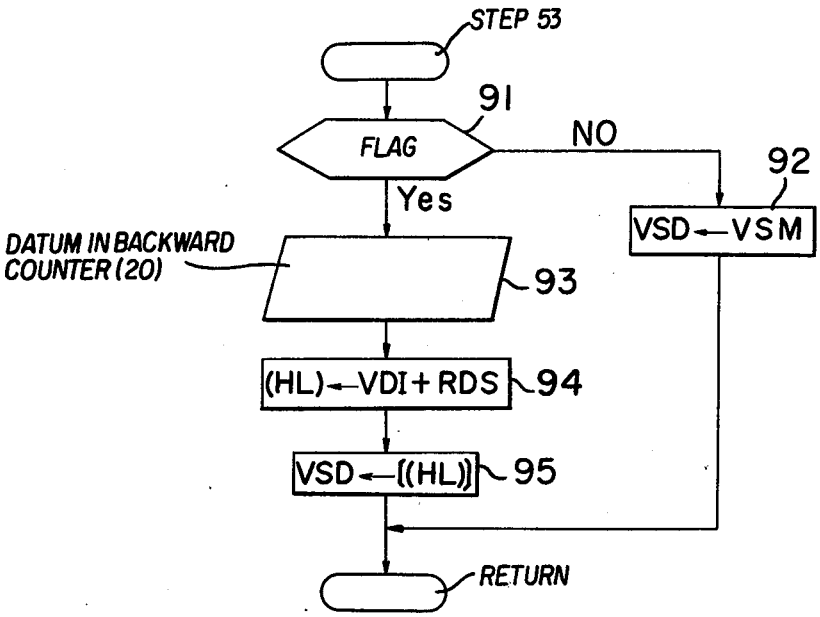

The state of the flag $S_1$ is determined in the step (91) shown in FIG. 12. When the flag $S_1$ is not set to "1" which corresponds to no actuation of the first terminal detector (3A), the slowdown command VSD is kept in correspondence to the predetermined datum VSM in the step (92). When the flag $S_1$ is set to "1". corresponding to actuation of the first terminal detector (3A), the steps (93)-(95) are performed. In the step (93), the residual distance to the top floor (1) as the datum of the down counter (20) is input and memorized as the residual distance RDS in the corresponding address of the RAM (16D). In the step (94), the sum of the top address $VD_1$ of the slowdown command data memorized in the ROM (16C) and the residual distance RDS is set in the index register HL. In the step (95), the slowdown command datum is extracted from the address given by the index register HL and memorized as the slowdown command VSD in the predetermined address of the RAM (16D).

Figure 13:
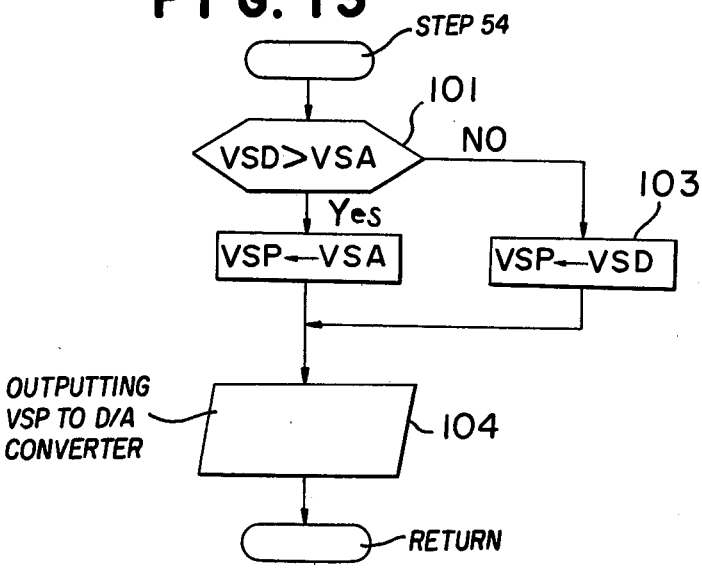
Figure 14:
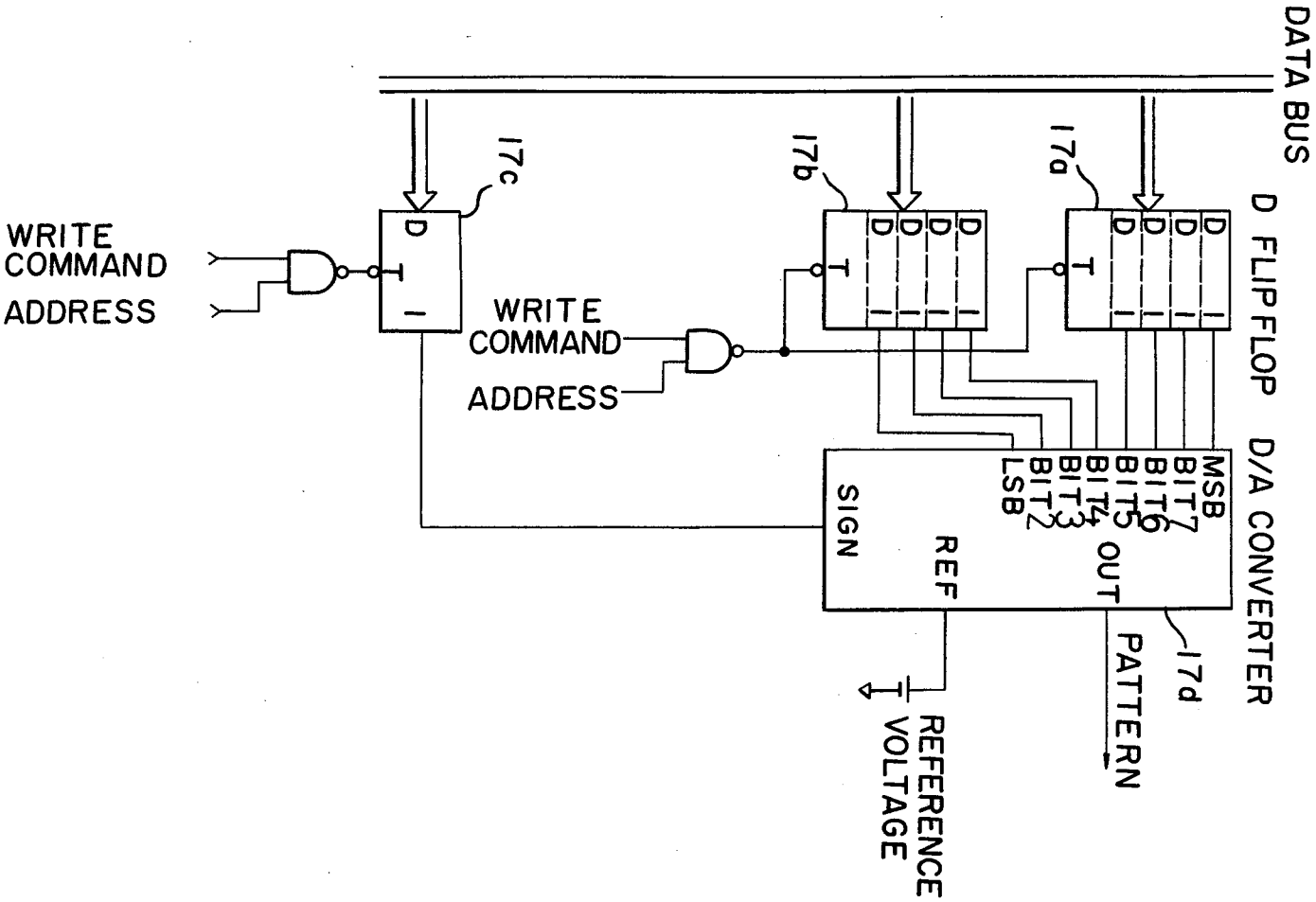
FIG. 14 is a circuit diagram of D/A converter.
Figure 15:
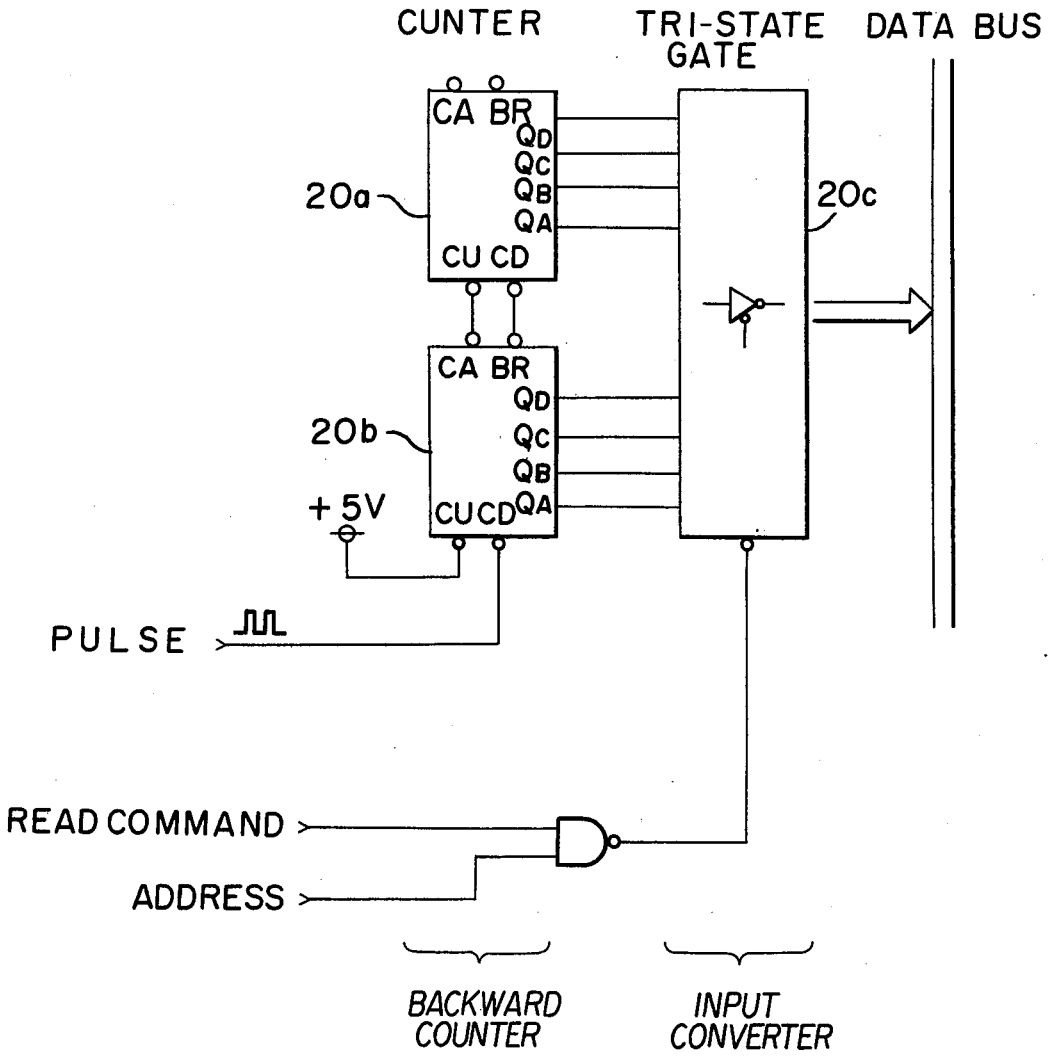
FIG. 15 is a circuit diagram of a down counter and an input converter.

In the step (101) shown in FIG. 13, the acceleration command VSA operated in the step (51) is compared with the slowdown command VSD operated in the step (53). In the case of VSD>VSA, the acceleration command VSA is memorized as the terminal speed command VSP in the predetermined address of the RAM (16D) whereas in the case of VSD≦VSA, the slowdown command VSD is memorized in the step (103) by the same manner. In the step (104), the terminal speed command VSP is output to the D/A converter (17) to complete the step (54). Thus, the processor (16) performs the steps (61), (62) shown in FIG. 10 before feeding the starting command to the processor (16) by the speed control device (19) whereby the initial speed Vso as the constant bias datum as shown in FIG. 6 is output to the D/A converter (17). When the starting command is fed, the acceleration command VSA increases each constant increase datum DVA to the predetermined datum Vsm in each trap period in the steps (63)-(65) and the command having the waveform in the acceleration mode (02) or the constant speed mode (03) shown in FIG. 6 is output to the D/A converter (17).

When the car (4) starts ascending driving from a middle floor, the terminal detectors (3A)-(3D) are not actuated. The step (52) is not performed. In the steps (91), (92) shown in FIG. 12, the slowdown command VSD is kept in the same datum VSM the same as the acceleration command VSA. When the car (4) reaches near the top floor (1), the first terminal detector (3A) is actuated. This, in the steps (71)-(74) shown in FIG. 11, the datum corresponding to the residual distance $L_1$ to the top floor (1) is preset at this time and the flag $S_1$ is set to "1".

In the step (91) shown in FIG. 12, the flag $S_1$ is set to "1". Thus, the extraction operation of the slowdown command VSD in the steps (93)–(95) is started. At this time, the contents of the down counter (20) must be $L_1$ whereby, the firstly extracted datum is the slowdown command $Dc_{L1}$ corresponding to the residual distance RDS. The residual distance RDS reduces depending upon the ascending of the car (4) whereby the slowdown command VSD is changed as $D_{cl1} \rightarrow \ldots D_{ci} \rightarrow D_{ci-1} \rightarrow \ldots$ The aforementioned problem will be illustrated. In the step (101) shown in FIG. 13, the slowdown command VSD is compared with the acceleration command VSA. When the slowdown command VSD decreases to be VSD<VSA, the operation mode (04) is given. In the step (103), the slowdown command VSD is set as the output VSP to the D/A converter (17). Thus, the waveform reducing depending upon the residual distance as shown in FIG. 6(*a*) is given as the terminal speed command after the actuation of the terminal detector (3A).

When the car (4) approaches to the top floor (1), the second terminal detector (3B) is actuated. Thus, in the steps (75)–(78) shown in FIG. 11, the datum corresponding to the residual distance $L_2$ at that time is preset in the down counter (20). That is, the residual distance as the datum of the down counter (20) is calibrated at the position of the actuation of the second terminal detector (3B) whereby the position accuracy is improved and the landing accuracy at the top floor (1) is improved. The datum extracted in the step (53) shown in FIG. 12 is calibrated to the slowdown command $D_{c12}$ corresponding to the residual distance RDS=$L_2$ from the position $D_{cn}$. When the third and fourth terminal detectors (3C), (3D) are actuated in the same manner, the datum $L_3$, $L_4$ is preset in the down counter (20) whereby the slowdown command VSD is calibrated as shown in FIG. 6(*a*) to give the slowdown command having high position accuracy.

Figure 1:
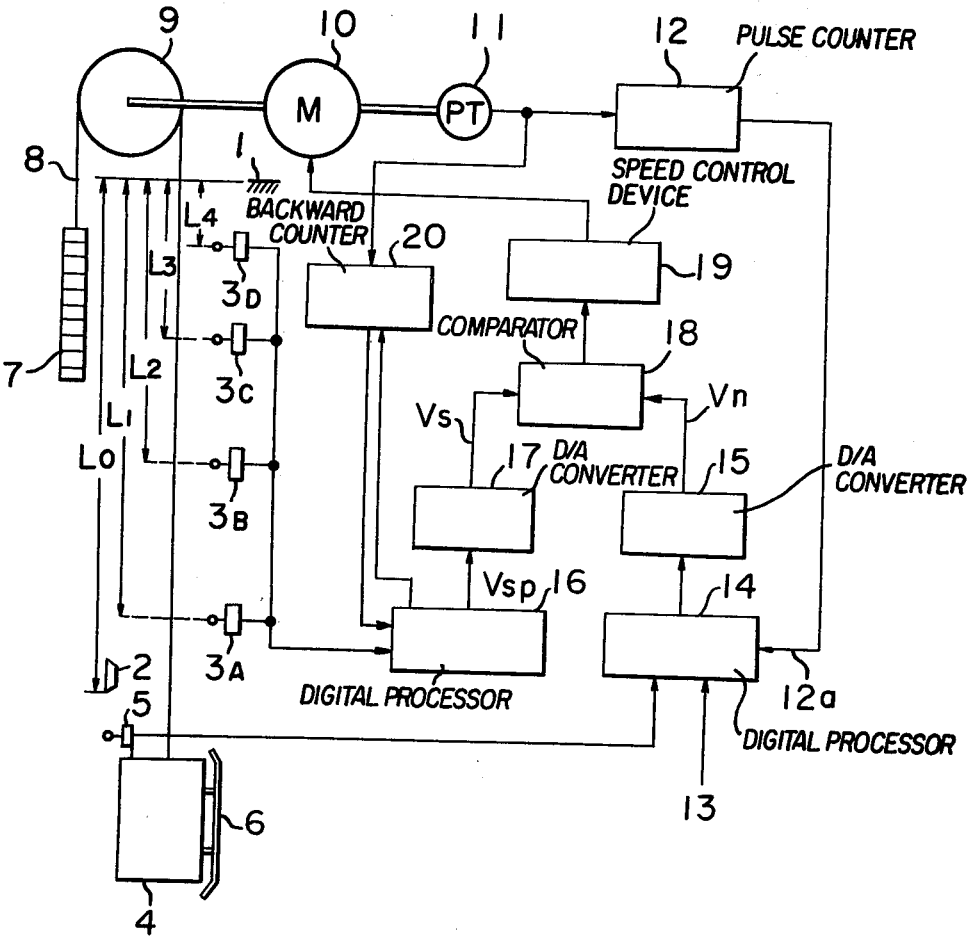
FIG. 1 is a block diagram of the conventional terminal slowdown apparatus for an elevator.
Figure 2:
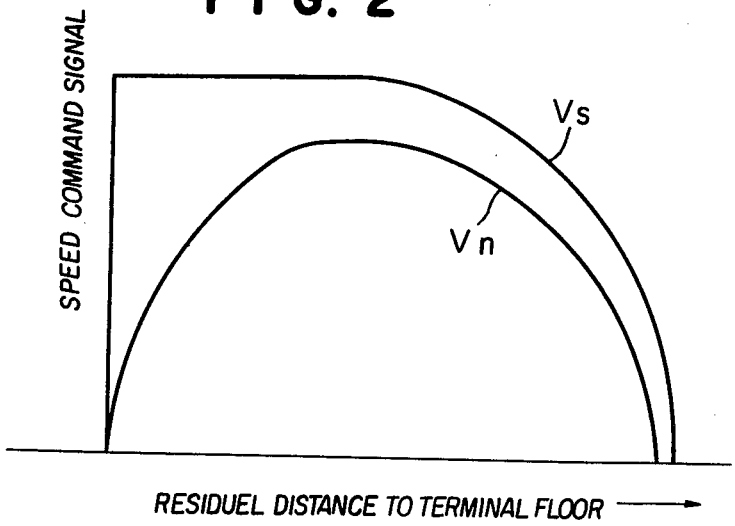
FIG. 2 is a graph showing curves of speed command signals of the apparatus of FIG. 1.
Figure 3:
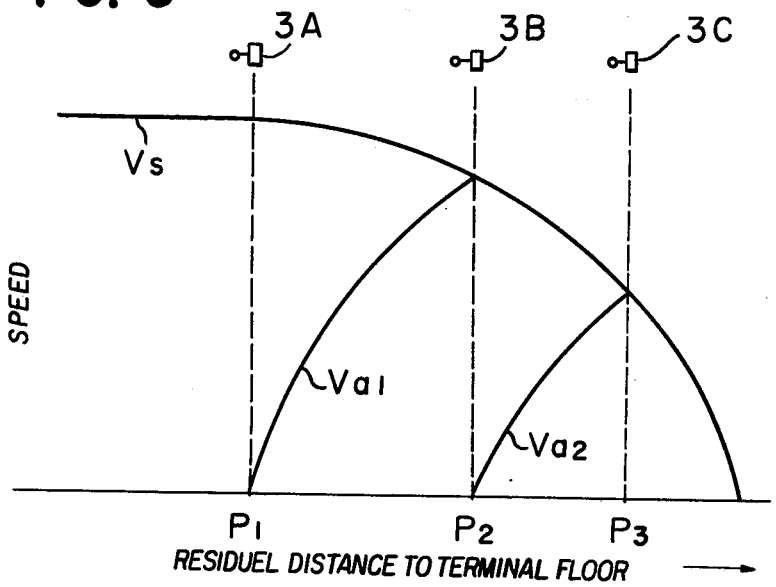
FIG. 3 is a diagram showing positions for placing terminal detectors of the appartus of FIG. 1.

The acceleration a in the determination of the positions and the number of the terminal detectors (3A)–(3D) can be calculated from the gradient of the acceleration command Vsa shown in FIG. 6(*a*) which is substantially the same as the gradient of the normal speed command signal Vn during acceleration and is smaller than the increase rate of the true speed $Va_1$-$Va_2$ of the car in FIG. 3. Thus, the positions of the terminal detectors (3B), (3C) can be placed farther the top floor (1) than the positions shown in FIG. 3. Therefore, the number of the terminal detectors (3A)–(3D) can be smaller than that of the conventional apparatus. For example, when the acceleration of the normal speed command signal Vn is given as 0.9 m/S$^2$, the gradient of the acceleration command Vsa of the terminal speed command signal Vsp can be about 1.0 m/S$^2$. In the case of the elevator having the rated speed of 240 m/min, the number of the terminal detectors (3A)–(3D) which is sufficient is 5 which is smaller than that of the conventional apparatus by 3.

The terminal speed command signal Vsp just after the start, is the constant bias datum Vso. Even though the gradient of the acceleration command Vsa is the same as the gradient of the normal speed command signal vn, there is no possibility to give Vsp (Vn in the normal driving). Therefore, the number of the terminal detectors (3A)–(3D) can be further decreased.

As described, in accordance with the present invention, the terminal detectors are placed at positions to provide the acceleration command for increasing from the starting of the car which is lower than the acceleration of the car caused in the starting during the saturated fault of the normal speed command and the terminal slowdown command signal generated at the time reaching to the normal slowdown position in the rated speed driving is equal to the acceleration command datum and the slowdown command for decreasing depending upon the distance to the terminal floor is operated after the actuation of the terminal detectors to output the lower signal among the acceleration command datum and the slowdown command datum as the terminal slowdown command signal whereby the car can be safely slowed down to land it at the terminal floor even though the number of the terminal detectors is small.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A terminal slowdown apparatus for slowing down an elevator car to stop the car at a terminal floor, wherein a normal speed command signal and a terminal slowdown signal are generated and used as the basis for controlling the speed of the car during selected predetermined modes of operation, comprising:

plural terminal detectors disposed at predetermined distances from said terminal floor for detecting passage of said car and for producing respective detection signals indicative of the position of said car with respect to said terminal floor;

first processor means for generating an acceleration command signal by which the speed of the car is increased from starting of the car at an acceleration lower than an acceleration of the car produced during the starting of the car during a saturation fault of the normal speed command signal;

at least one of said terminal detectors placed at a position at which normal slowdown operation of said car is started, said position determined in accordance with the rated running speed of said car and placed at a point wherein the acceleration command signal is equal to the terminal slowdown command signal;

a recalculating means coupled to said plural terminal detectors for recalculating the distance between said car and said terminal floor each time a detection signal is produced by said terminal detectors and for generating an output signal based on the recalculation distance;

a second processor means coupled to said output signal of said recalculating means for generating said terminal slowdown signals by which the elevator car is slowed down depending upon the recalculated distance between said car end the terminal floor, wherein the slowdown operation is initiated based on a detection signal from said at least one terminal detector;

a third processor means for comparing the outputs of said first and second processor means and for generating an output based on the lower of the outputs thereof as a terminal slowdown command signal by which the slowing down of the elevator car upon approaching a terminal is controlled.

2. A terminal slowdown apparatus as in claim 1 wherein said recalculation means comprises:

a backward counter.

3. A terminal slowdown apparatus as in claim 1 wherein said first processor means further comprises:

a central processing means; and a memory means connected to said central processing means.

* * * * *